US007347341B2

(12) United States Patent
Burggraf

(10) Patent No.: US 7,347,341 B2
(45) Date of Patent: Mar. 25, 2008

(54) AUTOMATED MEDICATION DISPENSER

(76) Inventor: Allen Burggraf, 5516 Boulder Hwy., #2F, Las Vegas, NV (US) 89122

( * ) Notice: Subject to any disclaimer, the term of this patent is extended or adjusted under 35 U.S.C. 154(b) by 405 days.

(21) Appl. No.: 10/083,180

(22) Filed: Feb. 25, 2002

(65) Prior Publication Data

US 2002/0125265 A1 Sep. 12, 2002

Related U.S. Application Data

(60) Provisional application No. 60/274,516, filed on Mar. 9, 2001.

(51) Int. Cl.
*G07F 11/00* (2006.01)

(52) U.S. Cl. ..... 221/3; 221/197; 221/287

(58) Field of Classification Search ..... 221/3, 221/9, 92, 103, 112, 114, 117, 174, 197, 287
See application file for complete search history.

(56) References Cited

U.S. PATENT DOCUMENTS 761,351 A * 5/1904 Beier ..... 221/91
2,684,781 A * 7/1954 Allen et al. ..... 221/1
4,993,591 A * 2/1991 Schock ..... 221/91
6,076,670 A * 6/2000 Yeranossian ..... 206/362
6,223,934 B1 * 5/2001 Shoenfeld ..... 221/71

* cited by examiner

*Primary Examiner*—Patrick Mackey
*Assistant Examiner*—Mark J. Beauchaine
(74) *Attorney, Agent, or Firm*—Leondard Weiss

(57) ABSTRACT

Each of four compartment blocks have a plurality of pill compartments with floors that are angled downward. The compartments have open ends of similar dimensions. The open ends are proximal to a door compartment. A retainer belt forms a loop around a tractor drive and the open ends. The retainer belt has a discharge port of substantially the same dimensions as the open ends. The tractor drive is operable to cause the discharge port to serially pass in alignment with the open ends. When the discharge port is in the discharge alignment one of the pill compartments, a sensor provides a stop signal to a control circuit. In response to the stop signal, the tractor drive stops moving the retainer belt. Additionally, medication from the one pill compartment passes through the discharge port into the door compartment. When the door compartment is opened, a switch provides a start signal.

20 Claims, 7 Drawing Sheets

AUTOMATED MEDICATION DISPENSER

Applicant claims the benefit of the provisional patent application No. 60/274,516 filed on Mar. 9, 2001.

BACKGROUND OF THE INVENTION

1. Field of Invention

This invention is in the general field of dispensing medication and, more particularly, automatically dispensing the medication in accordance with a schedule and signaling when the medication is dispensed.

2. Description of the Prior Art

An example of the prior art is U.S. Pat. No. 4,838,453, issued Jun. 13, 1998 to Lucksteed which discloses a disk having pockets which successively register with an opening in an underplate to permit medicine to fall into a tray. The disk is turned by a motor which is switched off at the proper time by a portion of ferrous material in the periphery of the disk which affects a magnetically sensitive switch.

U.S. Pat. No. 5,246,136 to Loisl discloses a dispensing device comprising a manually-turned disk having openings for receiving pills. The openings successively come into alignment with an opening above a drawer.

U.S. Pat. No. 4,674,651 of Skidmore has a disk with compartments about its periphery, the stopping of the disk being effected by means of lever-actuated pins on the disk, the pins adapted to contact a control switch.

Benorya's U.S. Pat. No. 4,572,403 provides a compartmented annular storage tray and a cover with a door which aligns successively with the compartments. The mechanism includes visual and audible alarms.

U.S. Pat. No. 5,472,113 of shaw provides a "vaned" wheel disposed on a horizontal axis with compartments between the vanes into which pills are inserted. When a disk rotates, the compartments successively align with a bottom opening in a surrounding housing. Means are provided to block over-discharge by shutting the dispenser down.

Heretofore there has not been a portable medication dispenser wherein a large amount of different medications are easily loaded for distribution to a patient over an extended length of time. Moreover, there has not been a portable medication dispenser that monitors the taking of the medication and provides for emergency care.

SUMMARY OF THE INVENTION

According to the present invention, a pill compartment has an open end that is proximal to a door compartment. A retainer belt forms a loop around a tractor drive and the open end. The retainer belt has a discharge port of substantially the same dimensions as the open end of the pill compartment. The tractor drive is operable to move the retainer belt to place the discharge port in alignment with the open end to provide a passageway through the discharge port into the door compartment. A sensor provides a stop signal to a control circuit when the discharge alignment occurs. In response to the stop signal, the tractor drive stops moving the retainer belt. When a door of the door compartment is opened, a switch provides a start signal.

DESCRIPTION OF THE PREFERRED EMBODIMENT

Figure 1:
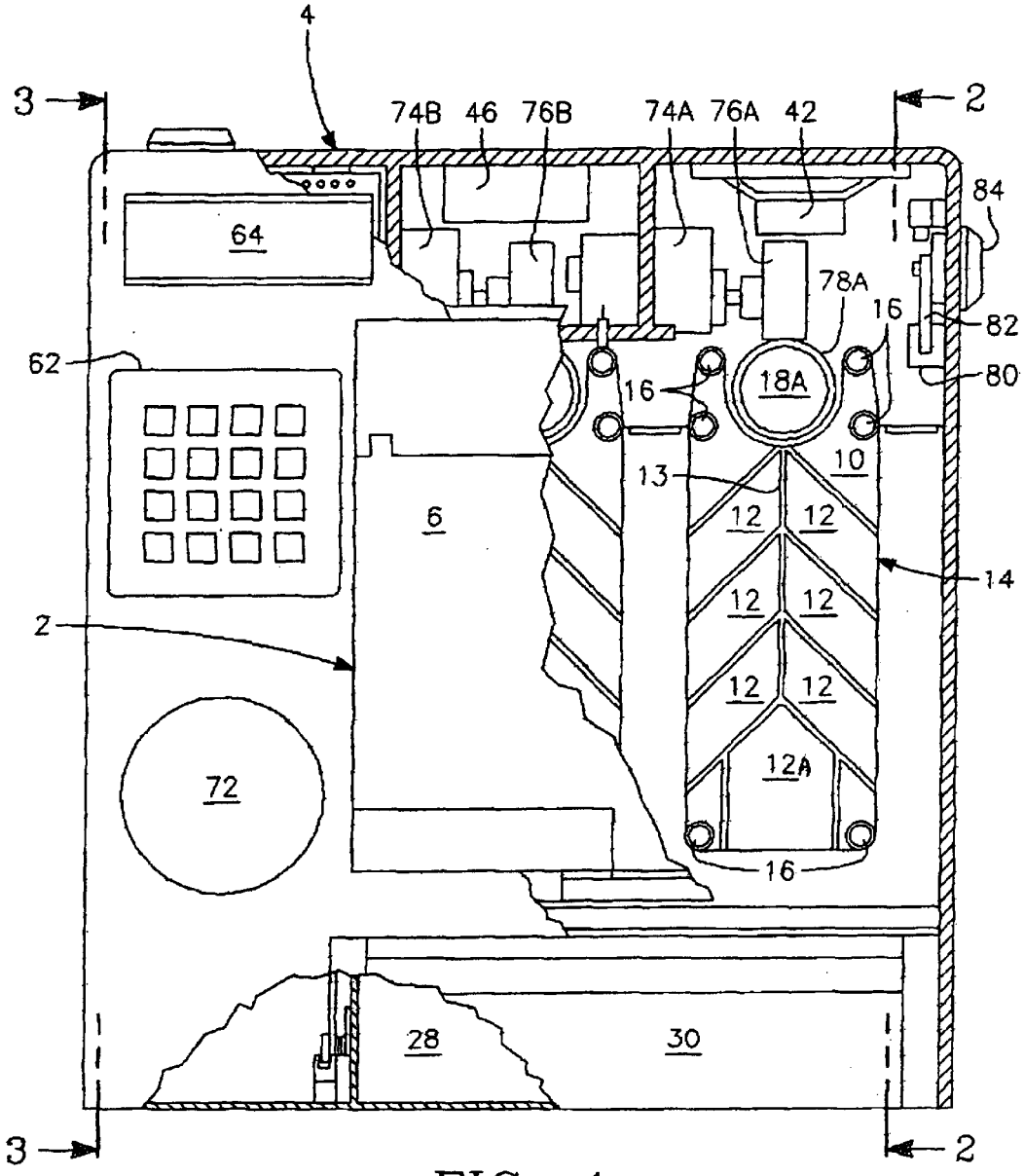
FIG. 1 is a front view of a dispenser of the preferred embodiment with parts broken away.

As shown in FIGS. 1 and 8, a medication dispenser includes a medication receptor 2 (FIG. 1) which is a cartridge of generally rectilinear shape. The medication dispenser additionally includes a housing 4 wherein the receptor 2 is removably installed. The receptor 2 has hinged front and rear faces 6, 8 (FIG. 8), respectively, that are opened when medication is loaded into the receptor 2.

The receptor 2 (FIG. 1) contains four compartment blocks that are exemplified by a compartment block 10. Within the block 10 are seven pill compartments 12 that are loaded with medication. Six of the compartments 12 each have a bottom floor angled at least 45 degrees downward from a center line 13 of the block 10 when the receptor 2 is installed in the housing 4. A seventh compartment 12 has a bottom floor that is horizontal. A retainer belt 14, made of a thin, flexible, non-stretching metal or plastic material, or a combination thereof, forms a loop around a series of six rollers 16, a tractor drive 18A and open ends of the compartments 12.

Figure 2:
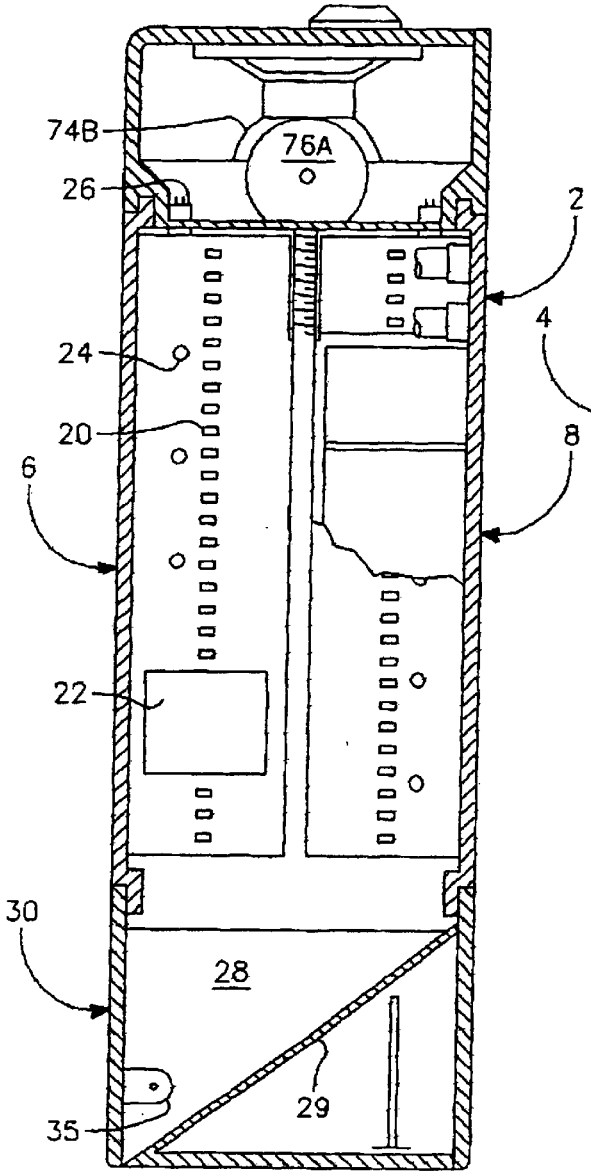
FIG. 2 is a section of FIG. 1 taken along the line 2—2.

As shown in FIG. 2, a series of evenly spaced tooth holes, exemplified by a tooth hole 20, are along a centerline of the belt 14. The tooth holes are sized and spaced to receive a series of evenly spaced gear teeth situated circumferentially on the tractor drive 18A (FIG. 1). A discharge port 22 is located on the centerline of the belt 14.

The discharge port 22 has substantially the same dimensions as an open end of each of the compartments 12. Accordingly, when the tractor drive 18A rotates, its gear teeth cause the discharge port 22 to rotate about the rollers 16 and serially pass in a discharge alignment with the open ends of the compartments 12. When the discharge port 22 is in the discharge alignment with the open end of one of the compartments 12, the angling of its bottom floor causes the medication therein to drop through the discharge port 22.

It should be understood that each of the three compartment blocks, in addition to the block 10, have pill compartments, similar to the compartments 12, and a retainer belt similar to the belt 14. As explained hereinafter, although two motors are operable to cause rotation of the belts, only one of the belts rotates at any given time.

A series of reflective positioning marks 24 are imbedded in the belt 14. Exemplary of four reflective optical sensors is an optical sensor 26 mounted inside the housing 4. When the discharge port 22 is in the discharge alignment with the open end of one of the compartments 12, light from the optical sensor 26 is reflected from one of the positioning marks 24 back to the optical sensor 26. In response to the reflected light, the optical sensor 26 provides a stop signal that causes the tractor drive 18A to stop rotating whereby the discharge alignment is maintained.

A door compartment 28 is built into the bottom of the housing 2. The door compartment 28 receives the medication that drops through the discharge port 22. A floor 29 of the door compartment 28 is angled downward from a vertical line (not shown) toward a door 30 (FIG. 1) in the housing 2. The door 30 covers the door compartment 28.

Figure 3:
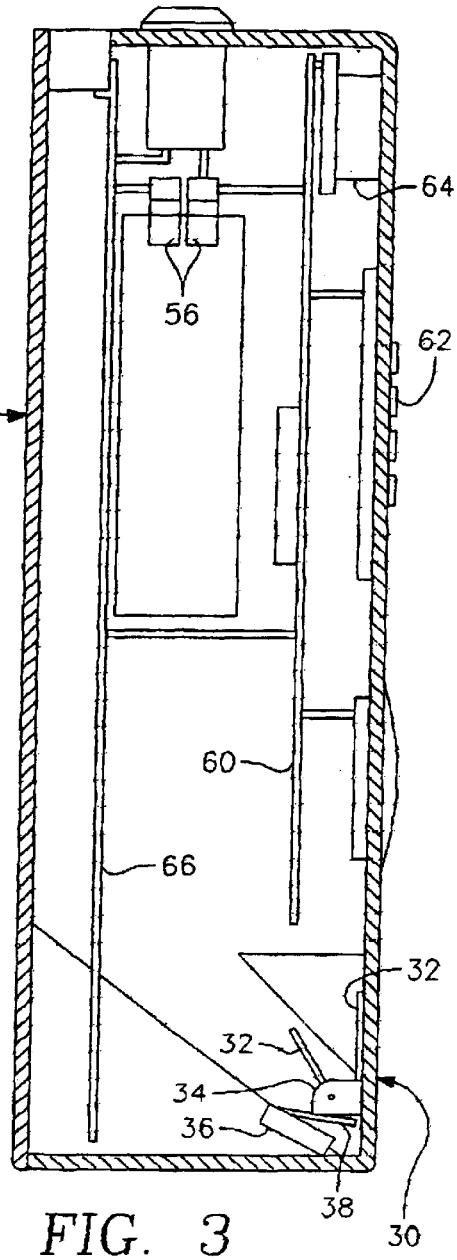
FIG. 3 is a section of FIG. 1 taken along the line 3—3.

As shown in FIGS. 2 and 3, a spring 32 (FIG. 3) is mounted upon the door 30. The spring 32 maintains the door 30 in a normally closed position.

The door 30 has hinges 34 (FIG. 3) and 35 (FIG. 2). When the door 30 is either opened of closed, it rotates about hinges 34, 35.

A door switch 36 is mounted inside the housing 4 adjacent to the door 30. The door switch 36 has an arm 38 that is proximal to the hinge 34. In response to the door 30 being opened, the arm 38 is moved by the hinge 34, thereby causing the switch 36 to provide a start signal.

In response to the start signal, the processor 68 causes a tractor drive in one of the four compartment blocks to rotate at a preprogrammed time.

Figure 4:
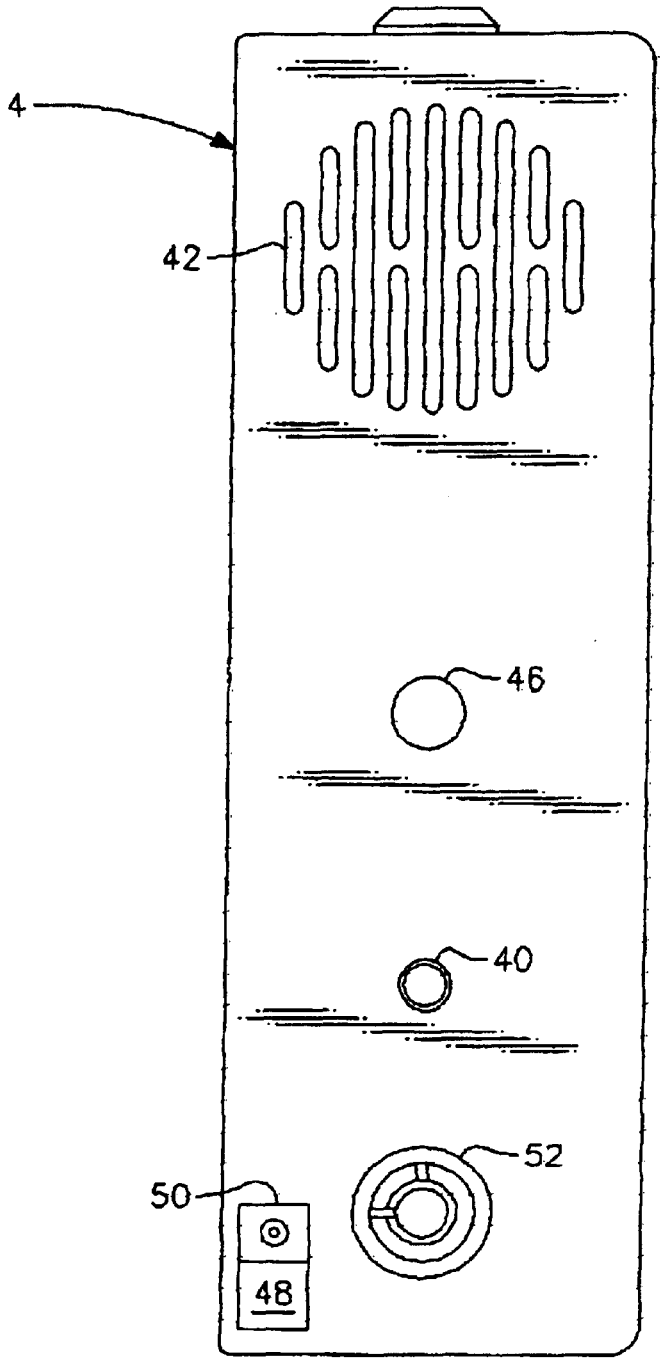
FIG. 4 is a top view of the embodiment of FIG. 1.

As shown in FIG. 4, a microphone 40, a speaker 42, and a high decibel screamer 46 are mounted in the top of the housing 4. The microphone 40, the speaker 42 and the screamer 46 are for communicating information to a patient relevant to the medication that is dispensed. A communication link 48, capable of receiving a standard telephone line, is additionally mounted in the top of the housing 4. An AC power link 50 capable of receiving a standard charger plug is mounted adjacent to the communication link 48. An on/off switch lock 52 is also mounted in the top of the housing 4.

It should be understood that when an AC voltage input source is plugged into the power link 50, a rectifier circuit (not shown) within the housing 2 converts the AC input voltage into a DC voltage. As explained hereinafter, The AC voltage input is used for charging a rechargeable power supply.

Figure 5:
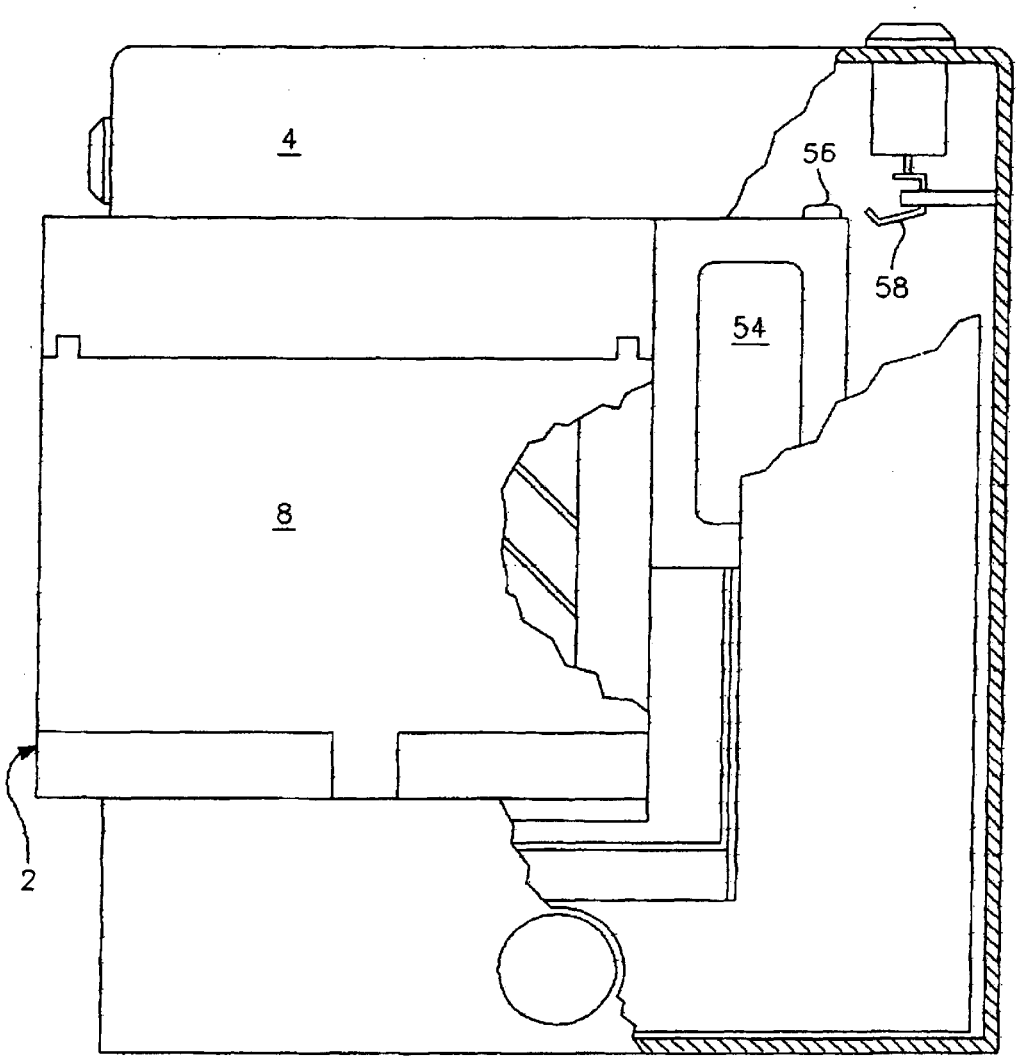
FIG. 5 is a rear view of a medication receptor of the dispenser partially inserted within a housing of the dispenser.

As shown in FIG. 5, a rechargeable power supply 54, such as a battery, is mounted within the receptor 2. The power supply 54 has a pair of contacts 56 (one shown). A pair of power contacts 58 (one shown) within the housing 4 are coupled to the on/off switch lock 52 and positioned so that they mate to the contacts 56 when the receptor 2 is completely within the housing 4. Therefore, the power supply 54 may be charged when the receptor 2 is not installed within the housing 4. When the receptor 2 is installed, the power supply 54 provides power to components within the housing 2 via the switch 52 and the contacts 58.

A circuit board #1 60 (FIG. 3) is positioned in an area behind a keypad 62 and a display 64 in the housing 4. An "L"-shaped circuit board #2 66 is installed in the back of the housing 4 behind circuit board #1 60 and the door compartment 28 (FIG. 5). The circuit boards 60, 66 are connected by a series of pins to allow circuits thereon to communicate with each other. Components of a control unit of the medication dispenser described hereinafter are mounted upon the circuit boards 60, 66.

Figure 6:
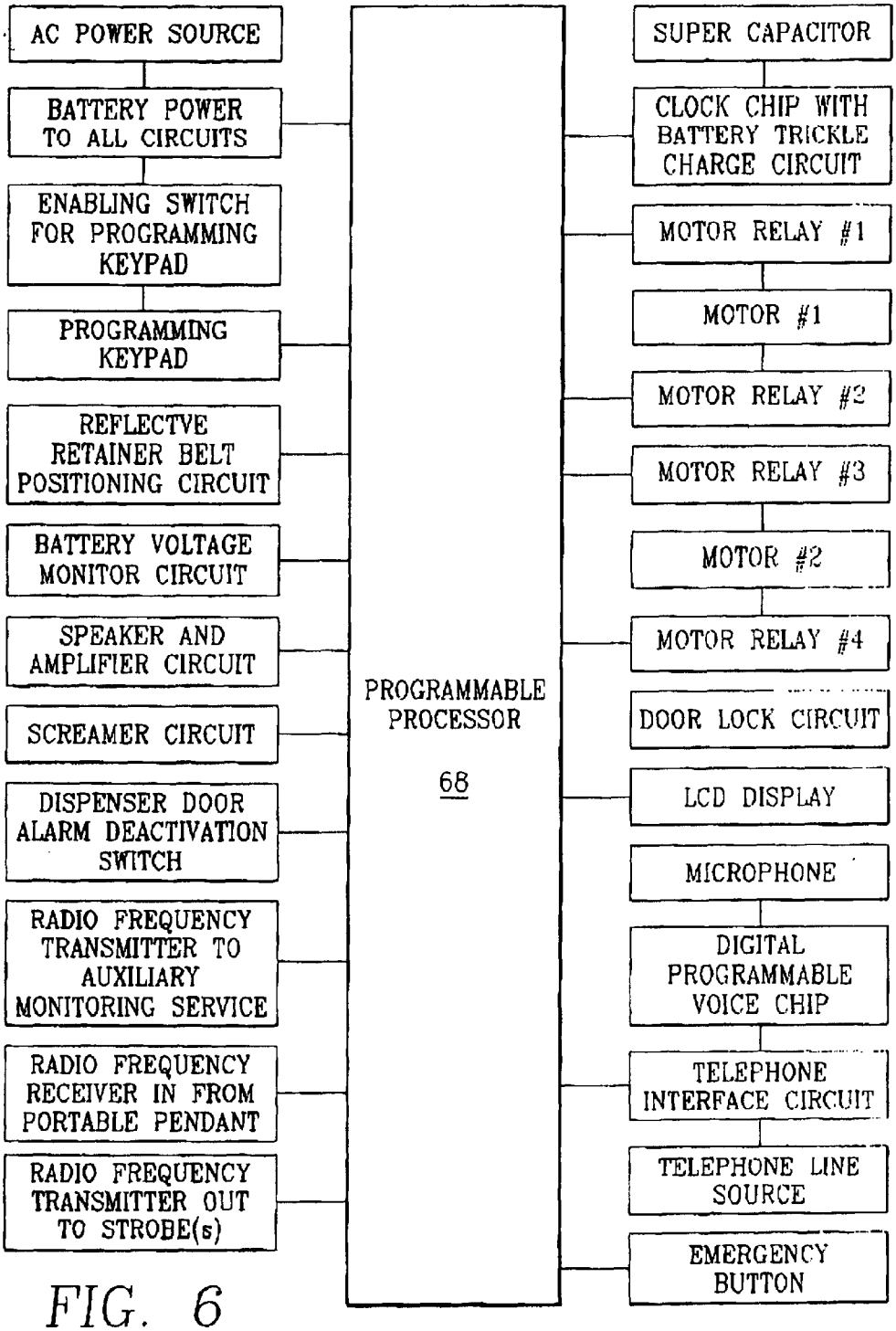
FIG. 6 is a line diagram of electronic components in the embodiment of FIG. 1.

Referring to FIG. 6, a processor 68 is mounted on circuit board #1 60. The processor 68 is an industry standard, programmable processor capable of generating standard telephone dial tones as well as any desired pitch or tone through an amplifier circuit. The processors 68 is capable of communication with an outside processor or computer via the communication link 48.

The processor 68 controls as well as receives data from outside circuitry including an amplifier circuit, screamer circuit, voice chip circuit, communication voice inject circuit, radio frequency receivers and transmitters, real time clock circuits, display circuits, keypad circuit, motor or other electrical relays, and communication circuits, all of which are located on the circuit boards 60, 66.

FIG. 6 includes a showing of an interrelationship between the processor 68 and the various circuits, chips, relays, and switches mounted or connected to the circuit boards 60, 66. For example, circuit board #1 60 holds a reflective retainer belt positioning circuit, a door lock circuit, a keypad circuit, a display circuit, a clock chip containing a battery trickle charge circuit, a super capacitor connected directly to the clock chip, a programming enabling switch, and four motor relays. The keypad 62 is connected directly to circuit board #1 60. Also, circuit board #1 60 is connected to the power contacts 58 on the on/off switch lock 52, as well as to the AC power link 50, providing electrical power to all circuits.

Circuit board #2 66 holds two separate radio frequency (RF) transmitter circuits (one for strobes and the other for an auxiliary monitoring service), an RF receiver circuit, a screamer circuit, a speaker and amplifier circuit, an alarm deactivation circuit, a telephone interface circuit, a battery voltage monitor circuit, and a digital programmable voice chip. The digital programmable voice chip is connected to the microphone 40 and is capable of digitally recording and storing voice and other audio messages.

An emergency button 72 is mounted upon the face 6 (FIG. 1) proximal to the keypad 62. The patient presses the button 72 when there is a medical emergency. The button 72 is connected to circuit board #2 66 via circuit board #1 60 and the circuit board connecting pins.

Preferably, the keypad 62 (FIG. 1) has sixteen alphanumeric buttons. It is connected to the circuit board #1 60 and the processor #1 68. Additionally, the display 64 is a standard alphanumeric LCD display capable of displaying text and data to the user. It is connected to the circuit board #1 60.

Dispenser motors 74A, 74B (FIG. 1) are mounted inside the upper portion of the housing 4 and are aligned so that the drive shafts are parallel to a transverse centerline of the housing 4 (FIG. 2). The dispenser motors 74A, 74B are standard DC gear reduction motors. Motor worms 76A, 76B are mounted to the shafts of the dispenser motors 74A, 74B, respectively. When the receptor 2 is installed in the housing 4, the top of the receptor 2 is open, thereby permitting motor worms 76A, 76B to engage worm gears 78A, 78B, respectively, in the receptor 2. Additionally, the bottom of the receptor 2 is open to allow the medication to fall through to the door compartment 12.

A receptor lock 80 has a notch 82 (FIG. 1) in the top of the receptor 2. The notch 82 is positioned to receive a locking arm 84 of the receptor lock 80 that is connected to the housing 4 thereby locking the receptor 2 within the housing 4.

Figure 7:
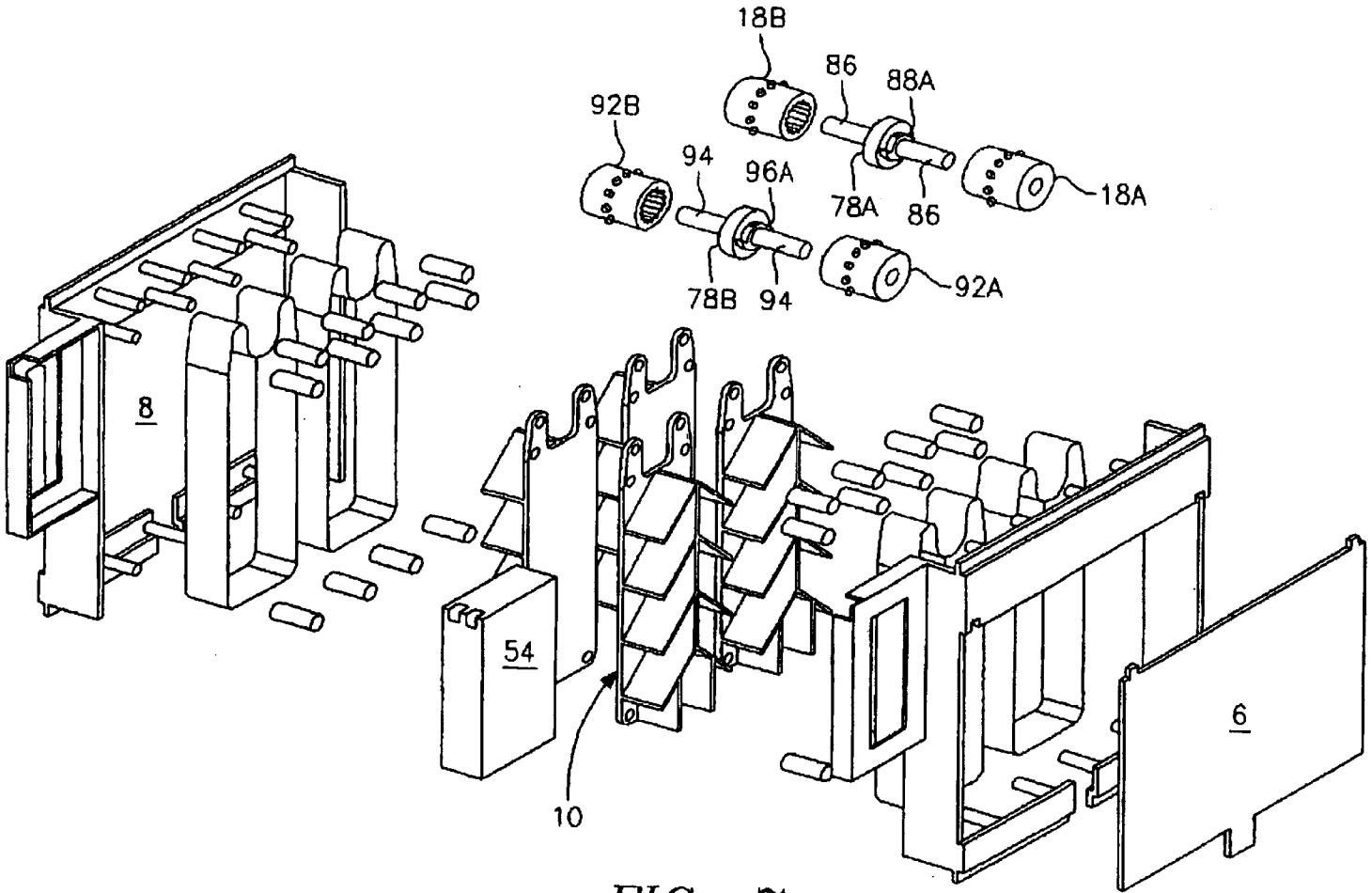
FIG. 7 is an exploded view of a receptor in the embodiment of FIG. 1.

As shown in FIG. 7, the tractor drives 18A, 18B are mounted on respective ends of an axle 86 inside of the receptor 2. The worm gear 78A is affixed to the axle 86 at its midpoint. When the receptor 2 is installed in the housing 4, the worm gear78A engages the motor worm 76A (FIG. 1) so that rotation of the motor worm 76A causes a corresponding rotation of the worm gear 78A.

A ratchet pawl 88A is affixed to the axle 86 proximal to one side of the worm gear 78A. A ratchet pawl 88B (not shown) is affixed to the axle 86 proximal to the other side of the worm gear 78A. Accordingly, rotation of the worm gear 78A causes a similar rotation of the ratchet pawls 88A, 88B.

Figure 8A:
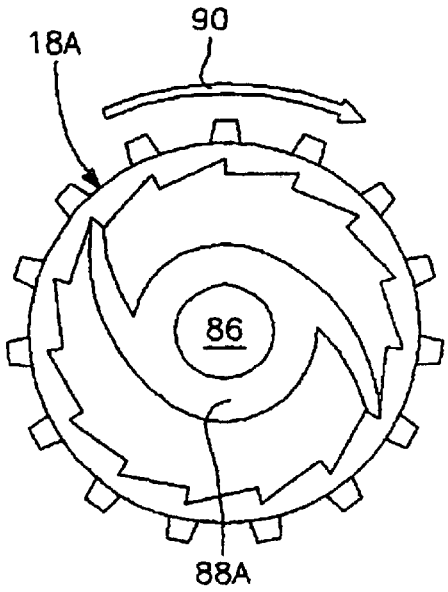
FIGS. 8A and 8B are plan views of a ratchet pawl coupled to a tractor drive.

As shown in FIG. 8A, when the ratchet pawl 88A is inserted in the tractor drive 18A, rotation of the worm gear 78A in a direction 90 causes the ratchet pawl 88A to engage the tractor drive 18A and thereby rotate it in the direction 90. Rotation of the ratchet pawl 88A in a direction opposite from the direction 90 causes the ratchet pawl 88A to ratchet inside the tractor drive 18A whereby there is no engagement that causes the tractor drive 18A to rotate.

Figure 8B:
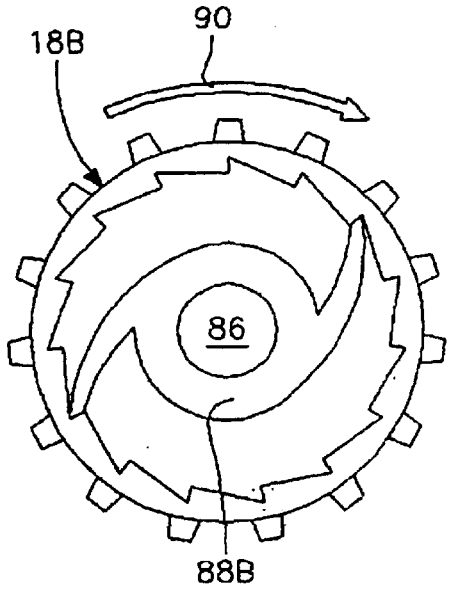

As shown in FIG. 8B, when the ratchet pawl 88B is inserted in the tractor drive 18B, rotation of the worm gear 78A in the direction opposite from the direction 90 causes the ratchet pawl 88B to engage the tractor drivel 8B and thereby rotate it in the direction opposite from the direction 90. Rotation of the ratchet pawl 88B in the direction 90 causes the ratchet pawl 88B to ratchet inside the tractor drive 18B whereby there is no engagement that causes the tractor drive 18B to rotate. Therefore, the tractor drives 18A, 18B cannot rotate simultaneously.

Correspondingly, the worm gear 78B (FIG. 7) is affixed to an axle 94 at its midpoint. When the receptor 2 is installed in the housing 4, the worm gear 78B engages the motor worm 76B (FIG. 1) so that rotation of the motor worm 76B causes a corresponding rotation of the worm gear 78B.

Tractor drives 92A, 92B are mounted on respective ends of an axle 94 inside of the receptor 2. The tractor drives 92A, 92B and the axle 94 are similar to the tractor drives 18A, 18B and the axle 86, respectively.

In a manner similar to that described in connection with the worm gear 78A, when the receptor 2 is installed in the housing 4, the worm gear78B engages the motor worm 76B (FIG. 1) so that rotation of the motor worm 76B causes a corresponding rotation of the worm gear 78B.

A ratchet pawl 96A is affixed to the axle 94 proximal to one side of the worm gear 78B. A ratchet pawl (not shown) is affixed to the axle 94 proximal to the other side of the worm gear 78B, whereby rotation of the worm gear 78B causes rotation of the tractor drives 92A, 92B in a manner similar to rotation of the tractor drives 18A, 18B caused by the rotation of the worm gear 78A.

It should be understood that the motors 74A, 74B (FIG. 1) are not energized simultaneously. Therefore, the axles 86, 94 do not rotate simultaneously. Because the axles 86, 94 do not rotate simultaneously and because of the ratchet pawls described hereinbefore, the retainer belt in only one of the four compartment blocks can rotate at any given time.

Figure 9:
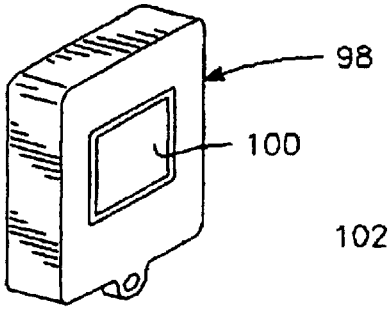
FIG. 9 is a perspective view of a pendant.

As shown in FIG. 9, a pendant 98 is equipped with an industry standard RF transmitter (not shown) capable of transmitting a signal to an RF receiver located on circuit board #2 66. The pendant 98 has a button 100 coupled to the transmitter therein. When the button 100 is depressed, it actuates the transmitter in the pendant 98.

Figure 10:
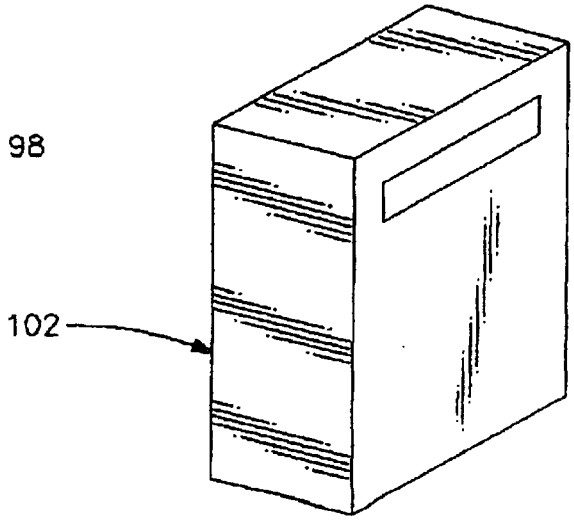
FIG. 10 is a perspective view of a strobe light.

As shown in FIG. 10, a strobe light 102 is equipped with an industry standard RF receiver (not shown) capable of receiving a signal from the RF transmitter circuit located on circuit board #2 66. A light bulb (not shown) is mounted at the front of the strobe light 102. In response to an RF signal received by the RF receiver of the strobe light 102, the bulb flashes. The strobe light 102 is equipped with a power plug (not shown) capable of being inserted into a standard AC electrical wall outlet.

The keypad 62 and display 64 are used to program processor 68 by entering, e.g., date, time, dispensing schedule, voice messages, telephone numbers, medication instructions, and alarm pitch, tone and duration settings. Entries are selected from menus that appear on the display 64. Alternatively, the processor 68 is programmed by a remote operator via the communication link 48 and a telephone interface circuit on the circuit board #2 66.

During normal non-dispensing time periods, the display 64 (FIG. 1) shows a date and time as they are kept by an internal real time clock (clock chip) located on the circuit board #1 60. A super capacitor mounted on the circuit board #1 60, provides backup power to the clock chip when the receptor 2 is removed from the housing 4.

The power supply 54 (FIG. 5) can be recharged by plugging a standard charger into the AC power link 50 (FIG. 4). Alternatively, the power supply 54 can be charged at an off-site location when the receptor 2 is not installed (for example, when it is replaced with a medication receptor that has been pre-loaded and pre-charged at an off-site location).

Turning the on/off switch lock 52 to the ON position provides power to the processor 68 and thereby activates the program of the processor 68. Reaching a scheduled medication dispensing time, as programmed into the processor 68, activates an appropriate one of the motors 74A, 74B which drives its corresponding motor worm (76A or 76B) in a programmed direction.

Thus, for example when the motor 74A (FIG. 1) is activated and causes a rotation of the tractor drive 18A in the clockwise direction, the ratchet pawl 88B ratchets inside (and does not move) the tractor drive 18B. Rotation of the tractor drive 18A causes the retainer belt 14 to move until the discharge port 22 becomes aligned with the open end of one of the compartments 12.

At the time of the alignment, the positioning mark 24 passes under the optical sensor 26 which sends a signal to the processor #1 68 that causes the motor 74A to stop and, thus, stop the movement of the retainer belt 14. Additionally, the processor 68 provides a signal that causes an alarm of a preset pitch, tone, volume and duration to be sent via the amplifier circuit through the speaker 42 to alert the patient that it is time to take the medication. Also, the processor 68 causes the display 64 to display preprogrammed medication instructions applicable to the medication that is dispensed.

When the patient opens the door 30 to retrieve the medication, the door switch 36 is tripped and sends a signal to the processor 68 that causes deactivation of the alarm. The processor 68 additionally causes the voice chip to send prerecorded voice messages, via the amplifier circuit, through the speaker 42 instructing the patient how to take the medication (e.g., take with water). When a predetermined period of time has passed after the door 30 is opened, the display 64 returns to showing the current date and time.

When the motor 74A is first started, the optical sensor 26 is not immediately powered up so that a previously read positioning mark 24 can pass from under the optical sensor 26. After a short delay, power is provided to the optical sensor 26 so that it can respond to the next positioning mark.

Preferably, the processor 68 causes the RF transmitter circuit on the circuit board #2 66 to send a signal activating one or more strobe light(s) 102 at the same time the alarm is activated. The strobe light(s) 102 may be installed in remote areas of a home, for example, where they can be seen by the patient. Also, when the alarm is deactivated, the processor 68 causes deactivation of the transmitter circuit on the circuit board #2 66, thereby shutting down the strobe light(s) 102.

When the door switch 36 is not tripped within a preprogrammed period of time after the medication is dispensed, processor 68 activates the high decibel screamer 46 in a further attempt to alert the patient. After another preprogrammed period of time has passed and the door switch 36 is still not tripped, the processor 68 begins a dialing sequence. More particularly, the processor 68 accesses a telephone line, via a telephone interface circuit installed on the circuit board #2 66 and the communication link 48, and dials the first of a preprogrammed set of up to four telephone numbers.

When the telephone is answered, the processor 68 activates the voice chip to send a prerecorded voice message over the phone line, via the telephone interface circuit and the communication link 48, to alert an answering party that the medication has not been taken or that there may be an emergency. The prerecorded voice message also instructs the answering party to press a button on their telephone to acknowledge receipt of the message. When the telephone is not answered and an acknowledging signal is not received by the processor 68, the preprogrammed set of telephone numbers are dialed indefinitely until an acknowledging signal is received.

In addition to, or instead of, the telephone dialing and notification procedure described above, processor 68 activates an auxiliary monitoring service RF transmitter installed on the circuit board #2 66. The monitoring service RF transmitter sends a radio frequency signal to a nearby receiver that is provided by, and monitored by, an auxiliary medical alert service.

Preferably, the pendant 98 is carried on the person of the patient. If an emergency situation occurs, the patient can depress the button 100, thereby causing the transmitter of the pendant 98 to send an RF signal which is received by the RF receiver circuit on the circuit board #2 66. The RF receiver circuit in the housing 4 then sends a signal to the processor 68 which initiates the dialing procedure and/or activates the auxiliary monitoring service RF transmitter as described above. In addition to using the pendant 98, the patient can initiate the emergency dialing procedure and/or alert the auxiliary monitoring service by pressing the button 72.

While one embodiment of the invention has been described above, it should be understood that it has been presented by way of example only and not limitation. For example alternative embodiments of the receptor 2 may have fewer than four compartment blocks to make the dispenser less expensive or more portable. Conversely, the receptor 2 may contain more than four compartment blocks to allow the dispensing of more doses of medication on a given day and/or reduce the number of times the receptor 2 needs to be refilled or replaced. Also, a simpler and less expensive dispenser may be built without, e.g., the digital programmable voice chip, RF transmitters and receivers, and emergency dialing and notification capabilities.

I claim:

1. A medication dispenser, comprising:

a pill compartment having an open end;

a tractor drive;

means for rotating said tractor drive;

a retainer belt that forms a loop around said tractor drive and said open end, said belt having a discharge port of substantially the same dimensions as said open end, a rotation of said tractor drive causing a rotation of said belt;

a programmable control unit;

a door compartment proximal to said open end; and means for stopping said rotation in response to said discharge port being in a discharge alignment with said open end, the alignment providing a passageway from said open end through said discharge port to said door compartment where medication is dispensed, said control unit causing said rotation at a preprogrammed time after a door of said door compartment is opened.

2. The medication dispenser of claim 1 wherein said control unit causes an alarm of a preset pitch, tone, volume and duration in response to said discharge alignment.

3. The medication dispenser of claim 2 wherein said door compartment has a floor that is angled downward from a vertical line.

4. The medication dispenser of claim 2 additionally comprising a speaker that provides said alarm.

5. The medication dispenser of claim 4 wherein said control unit causes a prerecorded voice message to be provided through said speaker in response to said door being opened.

6. The medication dispenser of claim 1 additionally comprising a display that provides preprogrammed medication instructions applicable to medication that is dispensed.

7. The medication dispenser of claim 1 additionally comprising a strobe light that is activated for a known duration in response to said discharge alignment.

8. The medication dispenser of claim 7, wherein said means for coupling comprises:

a motor worm connected to said motor's shaft;

a worm gear that is coupled to said motor worm, said worm gear rotating in response to rotation of said motor; and a ratchet pawl connected to said worm gear and said tractor drive, said ratchet pawl engaging said tractor drive when said motor's shaft rotates in said one direction.

9. The medication dispenser of claim 1 additionally comprising a high decibel screamer that is activated in response to said door not being opened within a preprogrammed period after said discharge alignment is attained.

10. The medication dispenser of claim 9 wherein said control unit accesses a telephone line in response to said door not being opened after said discharge alignment is attained, said control unit being adapted to provide an audio message via the telephone line.

11. The medication dispenser of claim 10 additionally comprising an emergency button that causes said control unit to access said telephone line.

12. The medication dispenser of claim 1 wherein said pill compartment has a floor that is angled downward from a vertical line.

13. The medication dispenser of claim 1 wherein said means for stopping comprises:

a reflective positioning mark embedded within said belt; and an optical sensor that transmits light, said positioning mark being positioned to receive the transmitted light and reflect it back to said sensor when the discharge alignment occurs, said sensor providing a stop signal to said control unit in response to the reflected light that causes said rotation to stop.

14. The medication dispenser of claim 1 additionally comprises a switch connected to said door, said switch providing a start signal in response to said door being opened.

15. The medication dispenser of claim 1 wherein said means for rotating comprises;

a motor; and means for coupling said motor to said tractor drive to cause rotation of said tractor drive in response to only one direction of rotation of said motor's shaft.

16. The dispenser of claim 1 additionally comprising means for programming said control unit.

17. The dispenser of claim 16 wherein said programming means comprises:

a keypad connected to said control unit: and a display connected to said control unit.

18. The dispenser of claim 16 wherein said programming means comprises:

a communication link adapted for connection to a standard telephone line, said communication link being connected to said control unit; and a display connected to said control unit.

19. The dispenser of claim 1 comprising:

a housing wherein said control unit is mounted; and a rechargeable power supply mounted in a cartridge that is adapted for installation within said housing; and means for connecting said power supply to said control unit when said cartridge is installed.

20. The dispenser of claim 19 wherein said pill compartment and said tractor drive are additionally mounted within said cartridge.

* * * * *